US008870344B2

(12) United States Patent
Martin et al.

(10) Patent No.: US 8,870,344 B2
(45) Date of Patent: Oct. 28, 2014

(54) CLEANING OF FLUID EJECTION ASSEMBLY

(71) Applicant: Hewlett-Packard Development Company, L. P., Houston, TX (US)

(72) Inventors: Scott Martin, Vancouver, WA (US); Thomas M Sabo, San Diego, CA (US); Christopher J Arnold, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/847,041

(22) Filed: Mar. 19, 2013

(65) Prior Publication Data

US 2014/0285573 A1 Sep. 25, 2014

(51) Int. Cl.
*B41J 2/165* (2006.01)

(52) U.S. Cl.
CPC ..... *B41J 2/16523* (2013.01)
USPC ..... 347/33

(58) Field of Classification Search
USPC ..... 347/33
See application file for complete search history.

(56) References Cited

U.S. PATENT DOCUMENTS

| | | | | | |
|---|---|---|---|---|---|
| 5,650,811 | A * | 7/1997 | Seccombe et al. | ..... | 347/85 |
| 5,793,390 | A * | 8/1998 | Claflin et al. | ..... | 347/33 |
| 6,135,585 | A * | 10/2000 | Johnson et al. | ..... | 347/32 |
| 2007/0081009 | A1 * | 4/2007 | Morgan et al. | ..... | 347/33 |
| 2012/0194610 | A1 | 8/2012 | Kyoso | | |

* cited by examiner

*Primary Examiner* — Stephen Meier
*Assistant Examiner* — Alexander D Shenderov
(74) *Attorney, Agent, or Firm* — Victor DeVito

(57) ABSTRACT

A method includes applying a nominal back pressure to a fluid ejection assembly and nozzles to form a first amount of back pressure therein by a back pressure regulator. The method also includes applying a first pressure to lower the first amount of back pressure within the fluid ejection assembly and the nozzles to form a second amount of back pressure therein by a pressurization module in response to an activation of a cleaning operation. The method also includes moving at least one of the fluid ejection assembly and a wicking member against each other to perform the cleaning operation. The wicking member moves relative to the fluid ejection assembly against and across the nozzle surface to transfer fluid residue from at least one of the nozzle surface and the nozzles to a portion of the wicking member to form a used wicking member portion.

18 Claims, 7 Drawing Sheets

CLEANING OF FLUID EJECTION ASSEMBLY

BACKGROUND

Printing apparatuses may include a fluid ejection assembly to form an image on media. The fluid ejection assembly may include a nozzle surface having a plurality of nozzles. The fluid ejection assembly may eject printing fluid from the nozzles and onto the media.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Figure 1:
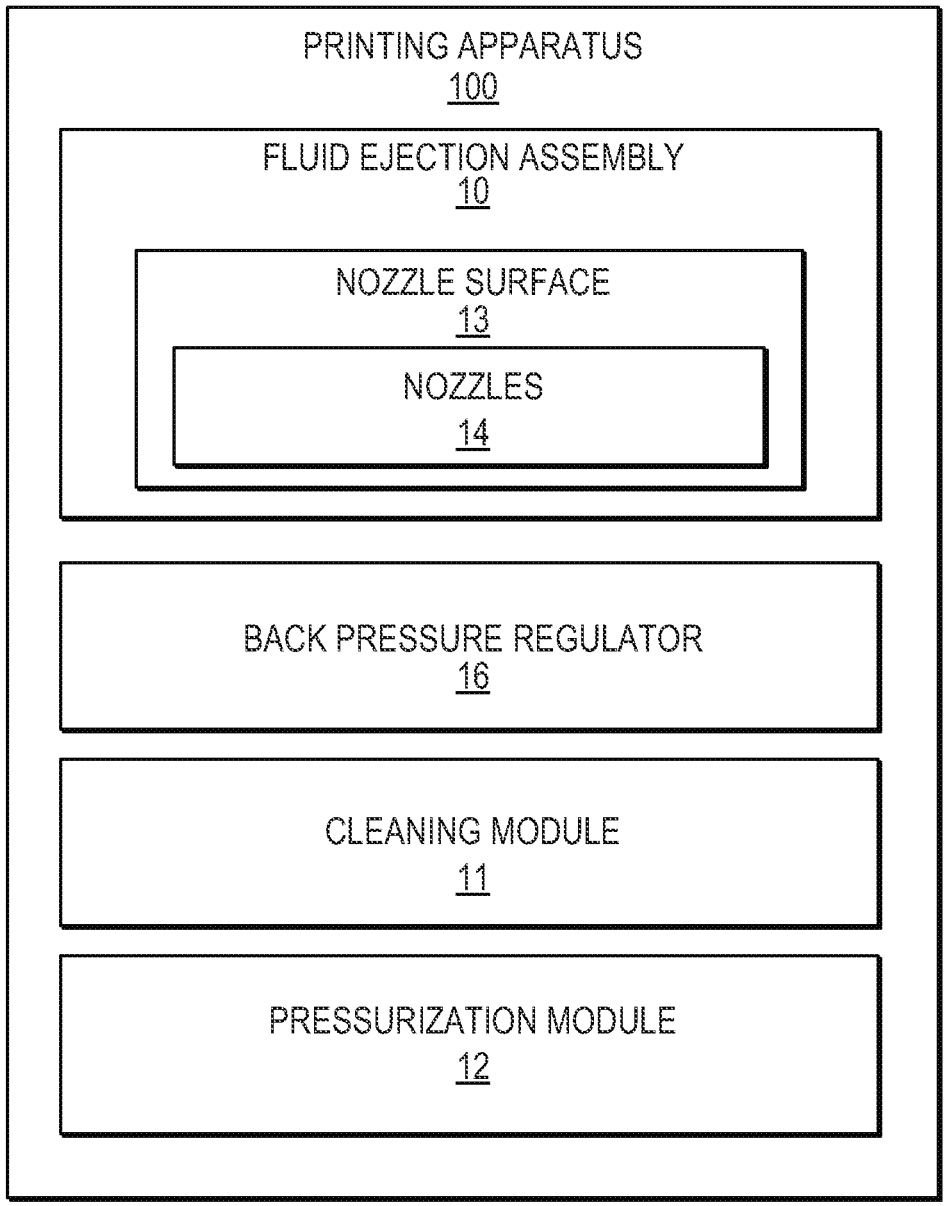
FIG. 1 is a block diagram illustrating a printing apparatus according to an example.

Printing apparatuses may include a fluid ejection assembly to form an image on media and a back pressure regulator to provide a nominal back pressure to reduce unwanted drooling of printing fluid and occurrences of depriming events from the fluid ejection assembly. The fluid ejection assembly, for example, may include an inkjet printhead including a nozzle surface having a plurality of nozzles. The back pressure regulator, for example, may include porous foam, and the like. The fluid ejection assembly may selectively eject printing fluid from the nozzles and onto media. For example, in a thermal inkjet printhead, a bubble may be generated by heat therein and subsequently collapse resulting in a printing fluid drop being ejected from a respective nozzle. Fluid residue may accumulate at the nozzle surface and nozzles. Periodically, a wicking member such as a web wipe may be repeatedly used to rub against the fluid ejection assembly and clean the nozzle surface and nozzles during a cleaning operation.

For example, when a web wipe is performed, a meniscus pressure at the respective nozzles may be overcome by a capillary draw provided by the wicking member to the nozzles for printing fluid to flow from the nozzles to the wicking member. As the wicking member is reused, the capillary draw may be decreased in which less printing fluid may be drawn out from the nozzles with each successive reuse. Consequently, the nominal back pressure and the tendency of the reused wicking member to push air into the nozzles once the respective menisci are broken may result in air ingestion into the nozzles. That is, air trapped between the wicking member and nozzle surface may be pushed into the nozzles due to reduced permeability of the used wicking member and also pulled into the nozzles due to the application of the nominal back pressure to the fluid ejection assembly and the nozzles. Such air and/or fluid residue may be ingested into the nozzles during a cleaning operation and impede proper printing fluid drop ejection therefrom. Thus, image quality may be decreased and/or fluid ejection assembly damage may result.

In examples, a method of cleaning a fluid ejection assembly including a nozzle surface having nozzles to eject printing fluid therefrom includes, amongst other things, applying a nominal back pressure to the fluid ejection assembly and the nozzles to form a first amount of back pressure therein by a back pressure regulator. The method also includes applying a first pressure to lower the first amount of back pressure within the fluid ejection assembly and the nozzles to form a second amount of back pressure therein by a pressurization module in response to an activation of a cleaning operation. The method also includes moving at least one of the fluid ejection assembly and a wicking member of a cleaning module against each other to perform the cleaning operation.

During the cleaning operation, a wicking member moves relative to the fluid ejection assembly against and across the nozzle surface to transfer fluid residue from at least one of the nozzle surface and the nozzles to a portion of the wicking member to form a used wicking member portion. Periodically, a wicking member such as a web wipe may be repeatedly used to rub against the fluid ejection assembly to clean the nozzle surface and nozzles during a cleaning operation. Such a reduction of pressure for a cleaning operation may reduce the tendency of air to be ingested into the nozzles and prolong reuse of the wicking member. Thus, image quality degradation and fluid ejection assembly damage may be reduced.

FIG. 1 is a block diagram illustrating a printing apparatus according to an example. Referring to FIG. 1, in some examples, a printing apparatus 100 includes a fluid ejection assembly 10, a back pressure regulator 16, a cleaning module 11, and a pressurization module 12. The fluid ejection assembly 10 may include a nozzle surface 13 having a plurality of nozzles 14. The fluid ejection assembly 10 may eject printing fluid from the nozzles 14. In some examples, the fluid ejection assembly 10 may include a printhead, plurality of printhead modules, a printbar, and/or a printhead assembly, and the like. For example, in a thermal inkjet printhead, a bubble may be generated by heat therein and subsequently collapse resulting in a printing fluid drop being ejected from a respective nozzle 14.

Referring to FIG. 1, in some examples, the back pressure regulator 16 may provide a nominal back pressure to the fluid ejection assembly 10 and the nozzles 14 to form a first amount of back pressure therein. In some examples, the back pressure regulator 16 may be disposed outside and/or inside the fluid ejection assembly 10. For example, the back pressure regulator 16 may be disposed in a printing fluid supply in fluid communication with the fluid ejection assembly 10. In some examples, the back pressure regulator 16 may include a porous foam member, and the like.

Referring to FIG. 1, in some examples, the cleaning module 11 may selectively move a wicking member 25 (FIGS. 2A and 3) against the nozzle surface 13 to remove fluid residue from at least one of the nozzle surface 13 and the nozzles 14 thereof during a cleaning operation. For example, the cleaning module 11 may be repositioned toward the fluid ejection assembly 10 and move the wicking member 25 against the nozzle surface 13 during a cleaning operation. Additionally, in some examples, the cleaning module 11 may be repositioned away from the fluid ejection assembly 10 in which the wicking member 25 may be moved away from the nozzle surface 13 in response to completion of a cleaning operation. In some examples, the cleaning module 11 may be repositioned by a motor, and/or mechanical members, and the like.

Referring to FIG. 1, in some examples, the pressurization module 12 may apply pressure to the fluid ejection assembly 10 and the nozzles 14. The pressurization module 12 may apply a first pressure to lower the first amount of back pressure within the fluid ejection assembly 10 and the nozzles 14 to form a second amount of back pressure therein in response to an activation of the cleaning operation. Thus, a back pressure state may exist during the cleaning operation and after completion of the cleaning operation. The back pressure state, for example, is a state in which the net pressure within the fluid ejection assembly 10 is negative. In some examples, the first pressure may correspond to a positive amount of pressure provided by the pressurization module 12 to be added to the second amount of back pressure within the fluid ejection assembly 10 resulting in a net back pressure being less negative (e.g., decrease in back pressure).

That is, the amount of pull on menisci of the printing fluid in the nozzles 14 into the fluid ejection assembly 10 will be decreased by application of the first pressure by the pressurization module 12. In some examples, the nominal back pressure and the first amount of back pressure may be about −9 inches H20. Also, in some examples, the first pressure may be about 7 inches H20. Consequently, in some examples, the second amount of back pressure may be about −2 inches H2O and formed in response to an activation of the cleaning operation. Consequently, a tendency of ingestion of air and/or fluid residue into the nozzles 14 when the wicking member 25 is moved against the nozzle surface 13 may be reduced.

Figure 2A:
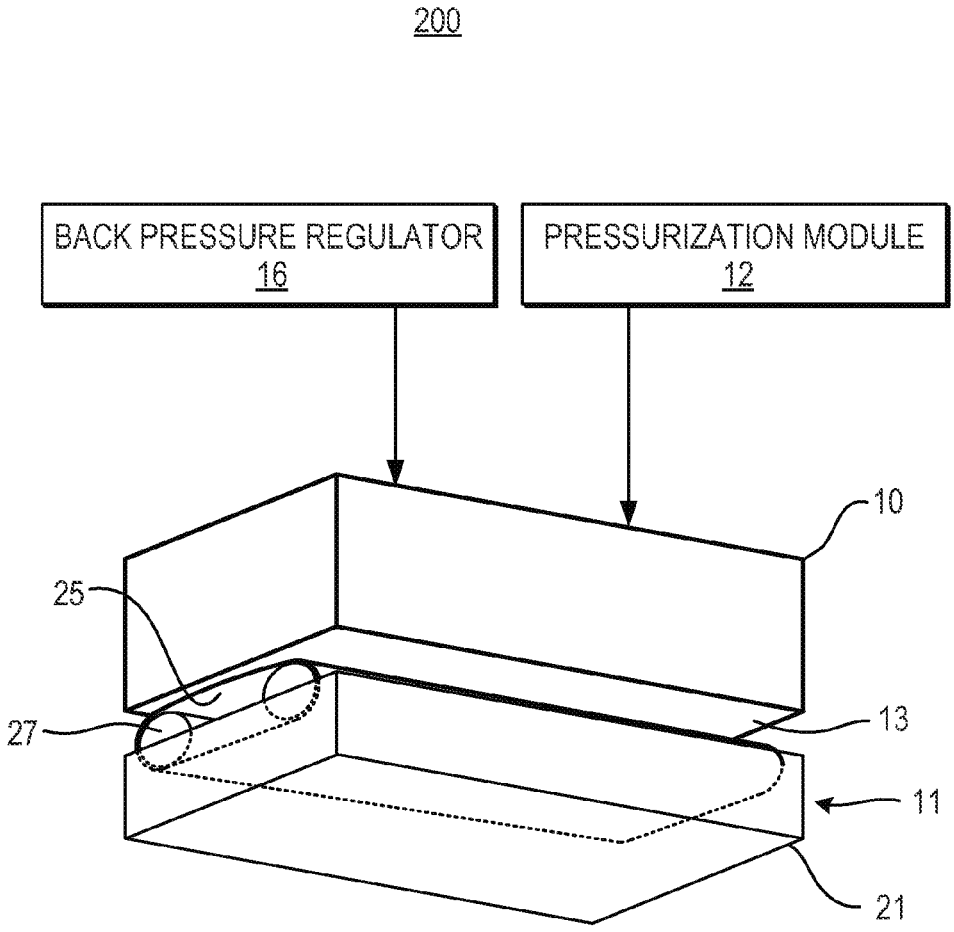
FIGS. 2A and 2B are schematic views illustrating a printing apparatus in a cleaning state and a non-cleaning state, respectively, according to examples.
Figure 2B:
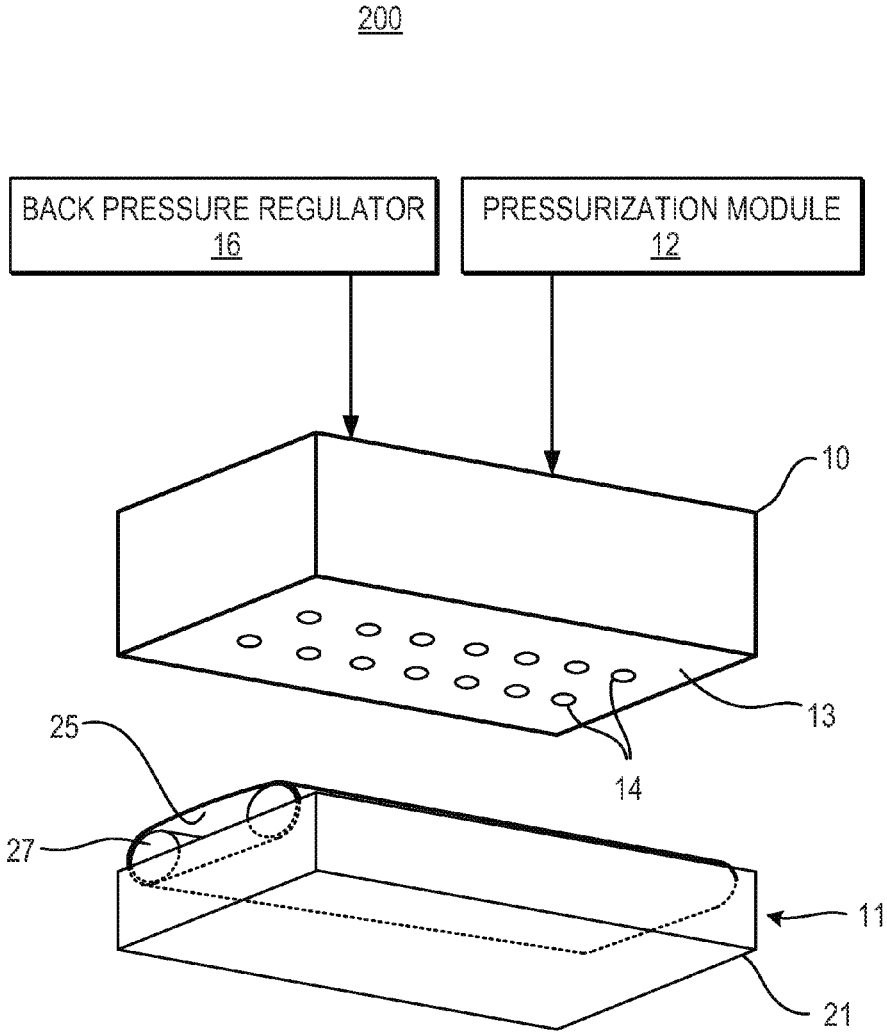
Figure 3:
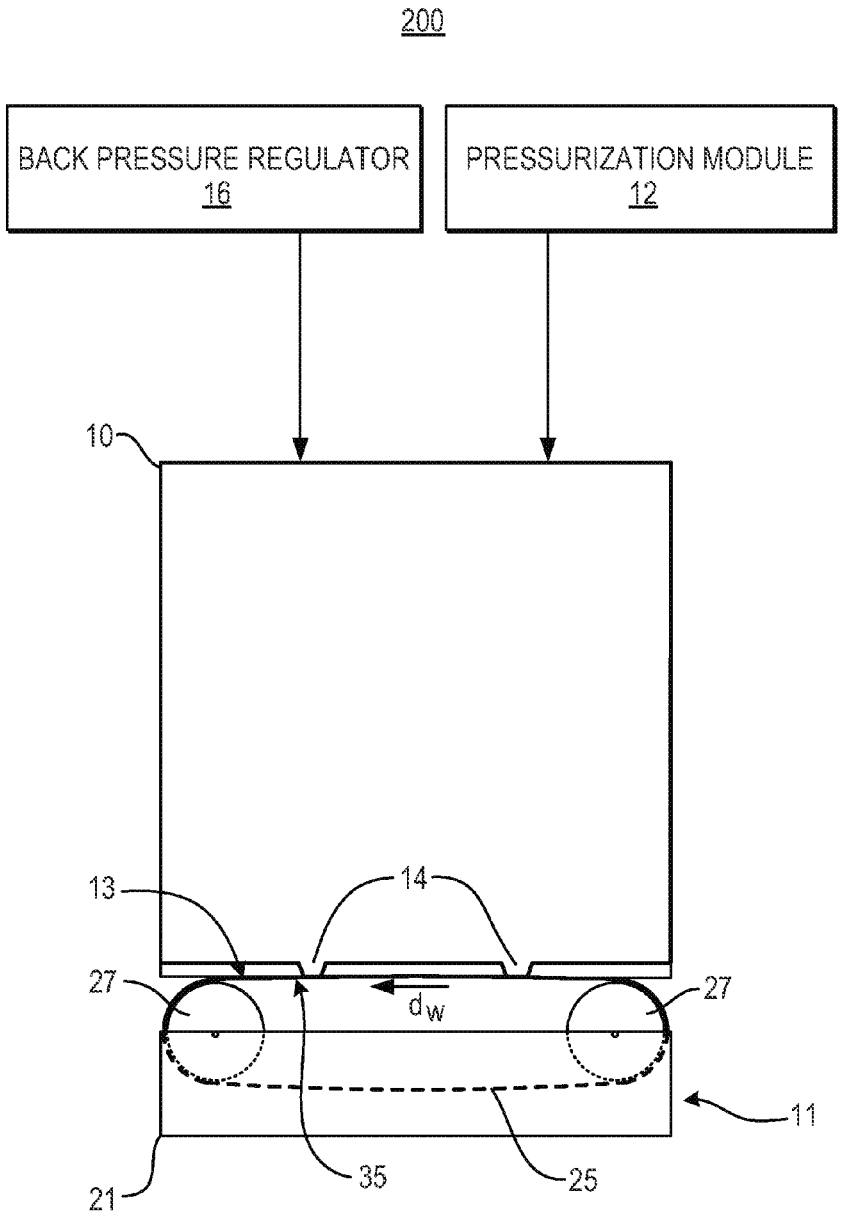
FIG. 3 is a schematic view illustrating the printing apparatus of FIG. 2A in a cleaning state according to an example.

FIGS. 2A and 2B are schematic views illustrating a printing apparatus in a cleaning state and a non-cleaning state, respectively, according to examples. FIG. 3 is a schematic view illustrating the printing apparatus of FIG. 2A in a cleaning state according to an example. Referring to FIGS. 2A-3, in some examples, the printing apparatus 200 may include the fluid ejection assembly 10, the back pressure regulator 16, the cleaning module 11, and the pressurization module 12 as previously described with respect to the printing apparatus 100 of FIG. 1.

As illustrated in FIG. 2A, the cleaning module 11 may selectively move the wicking member 25 against the nozzle surface 13 to remove fluid residue from at least one of the nozzle surface 13 and the nozzles 14 thereof during a cleaning operation. For example, in a cleaning state, the cleaning module 11 may be repositioned toward the fluid ejection assembly 10 and move the wicking member 25 in contact with the nozzle surface 13. Alternatively, in response to completion of the cleaning state such as in a non-cleaning state, the cleaning module 11 may be repositioned away from the fluid ejection assembly 10 and move the wicking member 25 out of contact with the nozzle surface 13 as illustrated in FIG. 2B.

Referring to FIGS. 2A-3, in some examples, the cleaning module 11 may include a wicking member 25, at least one cleaner transport member 27, and a housing 21. The wicking member 25 may include a web wipe having sufficient permeability to absorb fluid residue. At least one cleaner transport member 27 may move the wicking member 25 against and across the nozzle surface 13 to remove fluid residue therefrom. In some examples, the cleaning module 11 may include a plurality of cleaner transport members 27 such as cylindrical rollers to guide the wicking member 25 thereabout. One of the rollers, for example, may be a drive roller to move the wicking member 25. For example, the wicking member 25 may be arranged in an endless loop and move in a web transport direction d, about the cleaner transport members 27, and across the nozzle surface 13 and nozzles 14.

In some examples, the housing 21 may selectively move toward the fluid ejection assembly 10 to perform the cleaning operation and away from the fluid ejection assembly 10 in response to completion of the cleaning operation. The housing 21 may be coupled to at least one cleaner transport member 27. During the cleaning operation, the wicking member 25 may attract fluid residue from at least one of the nozzle surface 13 and the nozzles 14 to a portion of the wicking member 25 to form a used wicking member portion 35. The cleaning module 11 may move the used wicking member portion 35 against and across the nozzle surface 13 to attract fluid residue from at least one of the nozzle surface 13 and the nozzles 14 thereto during a subsequent cleaning operation.

Referring to FIGS. 2A-3, in some examples, the pressurization module 12 may apply pressure to the fluid ejection assembly 10 and the nozzles 14. As previously described, the pressurization module 12 may apply a first pressure to lower the first amount of back pressure within the fluid ejection assembly 10 and the nozzles 14 to form a second amount of back pressure therein in response to an activation of the cleaning operation. Additionally, in some examples, the pressurization module 12 may be configured to apply a second pressure that is less than the first pressure to increase the second amount of back pressure therein to form a third amount of back pressure therein in response to a completion of the cleaning operation.

In some examples, the second pressure may correspond to a negative amount of pressure provided by the pressurization module 12 to be added to the second amount of back pressure within the fluid ejection assembly 10 to form the third amount of back pressure. That is, the third amount of back pressure may correspond to a net back pressure being more negative (e.g., increase in back pressure) than the second amount of back pressure. In some examples, the second amount of back pressure may be about −2 inches H2O. Also, in some examples, the second pressure may be about −7 inches H2O. Consequently, in some examples, the third amount of back pressure may be about −9 inches H20 and formed in response to a completion of the cleaning operation. In some examples, the first amount of back pressure and the third amount of back pressure may be substantially the same.

Figure 4:
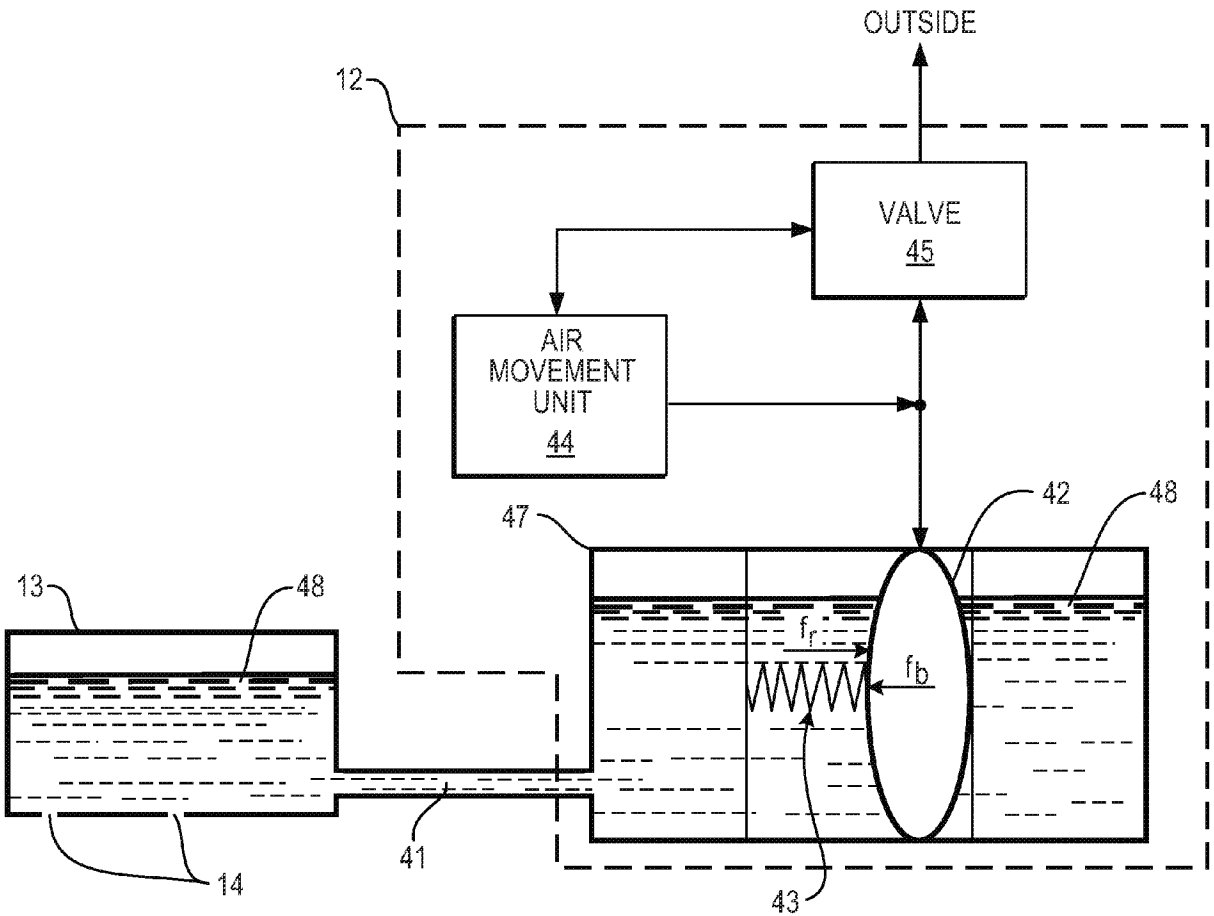
FIG. 4 is a schematic view illustrating a pressurization module and a fluid ejection assembly of the printing apparatus of FIG. 2B according to an example.

FIG. 4 is a schematic view illustrating a pressurization module and a fluid ejection assembly of the printing apparatus of FIG. 2B according to an example. Referring to FIG. 4, in some examples, the pressurization module 12 of the printing apparatus 200 may include an inflatable bag 42, a resilient member 43, an air movement unit 44, and a valve 45. The pressurization module 12 may be in fluid communication with the fluid ejection assembly 10 through a fluid channel 41 there between. The resilient member 43 may interact with the inflatable bag 42, for example, in an enclosed volume 47 of the printing fluid 48 and/or air. In some examples, the enclosed volume 47 may be in a form of a printing fluid supply.

The resilient member 43, for example, may surround the inflatable bag 42 and apply a force $f_r$ on the inflatable bag 42 and the surrounding fluid. In some examples, the force may be directly proportional to an amount of inflation of the inflatable bag 42. As the inflatable bag 42 inflates, the pulling tendency of the resilient member 43 may lessen and the back pressure may be reduced. Also, the inflatable bag 42 may apply a force $f_b$ to the resilient member 43 based on its inflation state. In some examples, the resilient member 43 may include a spring, and the like. In some examples, the air movement unit 44 may selectively provide air to inflate the inflatable bag 42. In some examples, the air movement unit 44 may include a pump, and the like. The valve 45 may remove the air from and deflate the inflatable bag 42 to its nominal inflation level. For example, the valve 45 may direct air from the inflatable bag 42 to outside the printing apparatus, for example, through a vent.

Referring to FIG. 4, in some examples, the pressurization module 12 may apply pressure to the fluid ejection assembly 10 and the nozzles 14. That is, the inflatable bag 42 may inflate to apply the first pressure to lower the first amount of back pressure within the fluid ejection assembly 10 and the nozzles 14 to form the second amount of back pressure therein in response to the activation of the cleaning operation. For example, the air movement unit 44 may provide steady air flow to the inflatable bag 42 and through the valve 45 which provides a controlled air flow resistance to limit bag inflation to an equilibrium state and thus a steady amount of applied pressure. Additionally, the inflatable bag 42 may deflate by either slowing or stopping the motor to apply a second pressure that is less than the first pressure to increase the second amount of back pressure within the fluid ejection assembly 10 and the nozzles 14 to form a third amount of back pressure therein in response to the completion of the cleaning operation. In some examples, the valve 45 may direct air to outside the printing apparatus in order to control air flow resistance during inflation or allow air to escape during deflation of the inflatable bag 42.

Figure 5:
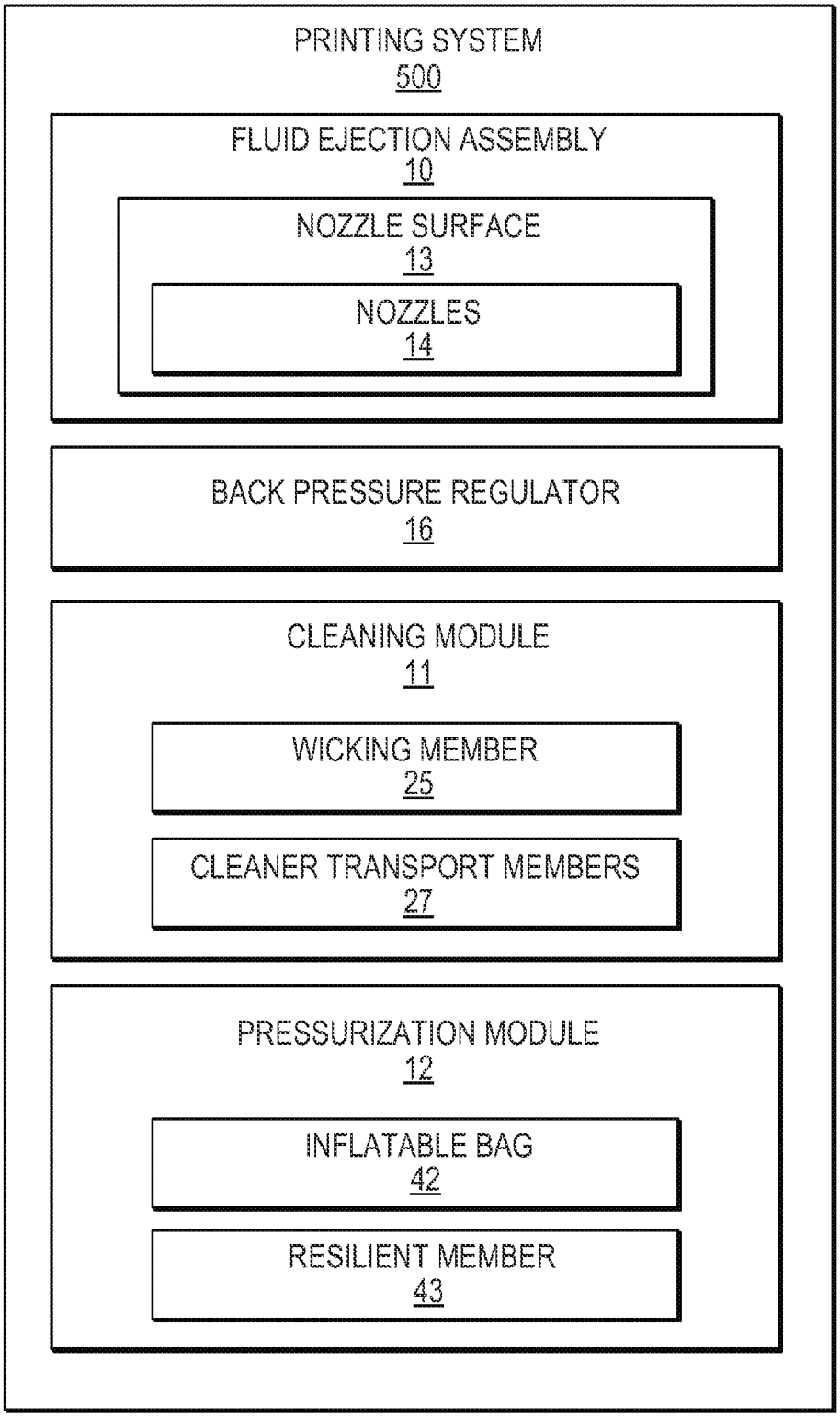
FIG. 5 is a block diagram illustrating a printing system according to an example.

FIG. 5 is a block diagram illustrating a printing system according to an example. Referring to FIG. 5, in some examples, a printing system 500 includes the fluid ejection assembly 10, the back pressure regulator 16, the cleaning module 11, and the pressurization module 12 as previously described with respect to the printing apparatuses 100 and 200 of FIGS. 1-4. Referring to FIG. 5, in some examples, the fluid ejection assembly 10 may include a nozzle surface 13 having a plurality of nozzles 14. The fluid ejection assembly 10 may eject printing fluid from the nozzles 14. The back pressure regulator 16 may provide a nominal back pressure to the fluid ejection assembly 10 and the nozzles 14 to form a first amount of back pressure therein.

Referring to FIG. 5, in some examples, the cleaning module 11 may include a wicking member 25, and cleaner transport members 27. The cleaner transport members 27 may move the wicking member 25 against and across the nozzle surface 13 to attract fluid residue from at least one of the nozzle surface 13 and the nozzles 14 to a portion of the wicking member 25 to form a used wicker member portion 35 during a cleaning operation. The cleaning module 11 may move the used wicking member portion 35, for example, between cleaner transport members 27 against and across the nozzle surface 13 for a subsequent cleaning operation.

Referring to FIG. 5, in some examples, the pressurization module 12 may apply an amount of pressure to the fluid ejection assembly 10 and the nozzles 14. The pressurization module 12 may include an inflatable bag 42, and a resilient member 43 as previously described with respect to the printing apparatus 200 of FIG. 4. The inflatable bag 42 may inflate and interact with the resilient member 43 to apply a first pressure to lower the first amount of back pressure within the fluid ejection assembly 10 and the nozzles 14 to form a second amount of back pressure therein in response to the activation of the cleaning operation. In some examples, the inflatable bag 42 may deflate to apply the second pressure that is less than the first pressure to increase the second amount of back pressure within the fluid ejection assembly 10 and the nozzles 14 to form the third amount of back pressure therein in response to the completion of the cleaning operation. In some examples, the pressurization module 12 may also include an air movement unit 44 and a valve 45 as previously described with respect to the printing apparatus 200 of FIG. 4.

Figure 6:
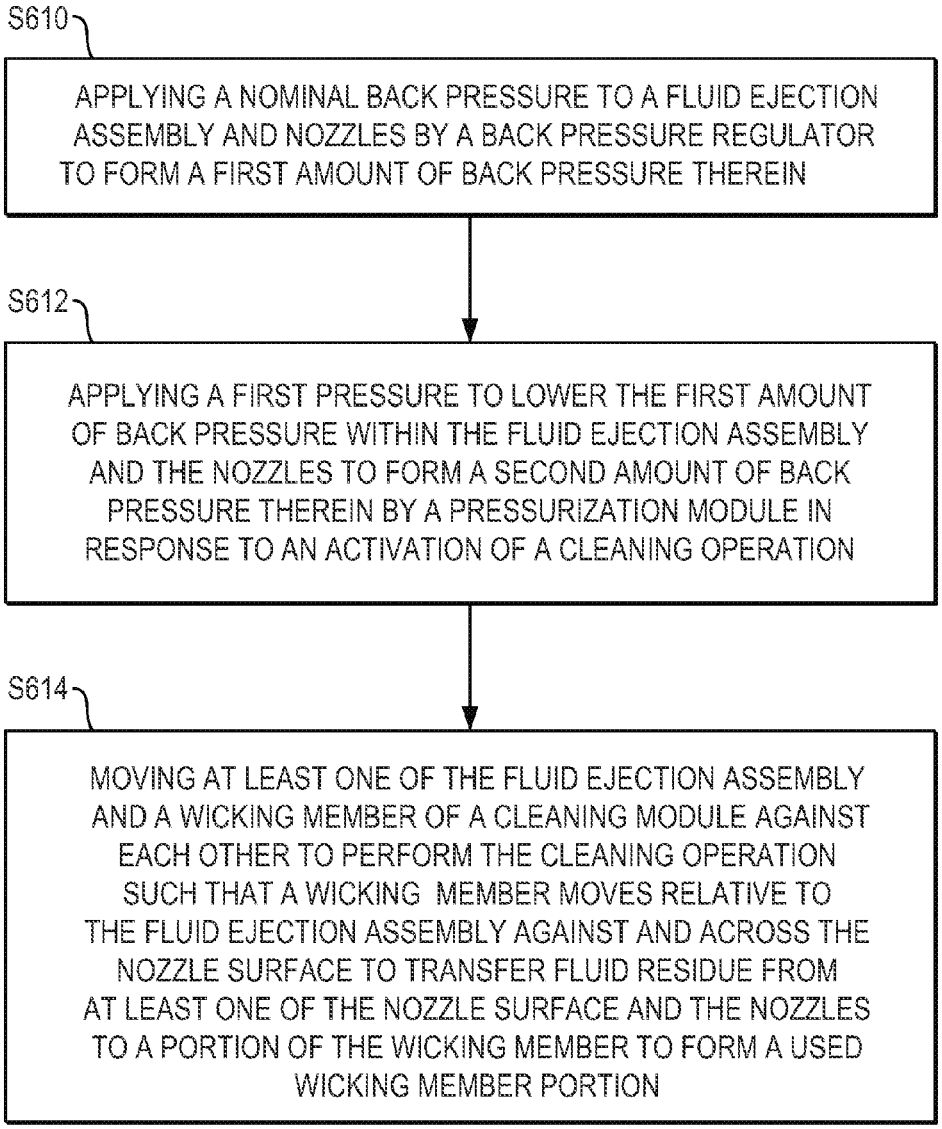
FIG. 6 is a flowchart illustrating a method of cleaning a fluid ejection assembly including a nozzle surface having nozzles to eject printing fluid therefrom according to an example.

FIG. 6 is a flowchart illustrating a method of cleaning a fluid ejection assembly including a nozzle surface having nozzles to eject printing fluid therefrom according to an example. In block S610, a nominal back pressure is applied to the fluid ejection assembly and the nozzles by a back pressure regulator to form a first amount of back pressure therein. In block S612, a first pressure to lower the first amount of back pressure within the fluid ejection assembly and the nozzles to form a second amount of back pressure therein is applied by a pressurization module in response to an activation of a cleaning operation. For example, an inflatable bag of the pressurization module may inflate to apply the first pressure to lower the first amount of back pressure within the fluid ejection assembly and the nozzles and to form the second amount of back pressure therein in response to the activation of the cleaning operation.

In block S614, at least one of the fluid ejection assembly and a wicking member of a cleaning module is moved against each other to perform the cleaning operation. Additionally, a wicking member moves relative to the fluid ejection assembly against and across the nozzle surface to transfer fluid residue from at least one of the nozzle surface and the nozzles to a portion of the wicking member to form a used wicking member portion. For example, the wicking member of the cleaning module may be moved against and across the nozzle surface to perform the cleaning operation to transfer the fluid residue from at least one of the nozzle surface and the nozzles to the portion of the wicking member to form the used wicking member portion.

In some examples, the method may also include applying a second pressure that is less than a first pressure to increase the second back pressure within the fluid ejection assembly and the nozzles to form the third amount of back pressure therein in response to a completion of the cleaning operation. For example, the inflatable bag of the pressurization module may deflate to apply the second pressure to increase the second amount of back pressure within the fluid ejection assembly and the nozzles to form the third amount of back pressure therein in response to the completion of the cleaning operation. In some examples, the first amount of back pressure and the third amount of back pressure may be substantially equal.

In some examples, the method may include applying the first pressure to lower the third amount of back pressure within the fluid ejection assembly and the nozzles to form a fourth amount of back pressure therein by the pressurization module in response to an activation of a subsequent cleaning operation. In some examples, the second amount of back pressure and the fourth amount of back pressure may be substantially equal. Additionally, the method may include moving the used wicking member portion against and across the nozzle surface of the fluid ejection assembly by the cleaning module to transfer fluid residue from the nozzle surface and the nozzles to the used wicking member portion to perform the subsequent cleaning operation.

It is to be understood that the flowchart of FIG. 6 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 6 illustrates a specific order of execution, the order of execution may differ from that which is depicted. For example, the order of execution of two or more blocks may be rearranged relative to the order illustrated. Also, two or more blocks illustrated in succession in FIG. 6 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A method of cleaning a fluid ejection assembly including a nozzle surface having nozzles to eject printing fluid therefrom, the method comprising:

applying a nominal back pressure to the fluid ejection assembly and the nozzles to form a first amount of back pressure therein by a back pressure regulator, applying a first pressure to lower the first amount of back pressure within the fluid ejection assembly and the nozzles to form a second amount of back pressure therein by a pressurization module in response to an activation of a cleaning operation, the pressurization module including an inflatable bag and a resilient member interacting with the inflatable bag to apply the first pressure; and moving at least one of the fluid ejection assembly and a wicking member of a cleaning module against each other to perform the cleaning operation.

2. The method of claim 1, further comprising:

applying a second pressure that is less than the first pressure to increase the second amount of back pressure within the fluid ejection assembly and the nozzles to form a third amount of back pressure therein by the pressurization module in response to a completion of the cleaning operation.

3. The method of claim 2, further comprising:

applying the first pressure to lower the third amount of back pressure within the fluid ejection assembly and the nozzles to form a fourth amount of back pressure therein by the pressurization module in response to an activation of a subsequent cleaning operation; and moving a used wicking member portion against and across the nozzle surface of the fluid ejection assembly by the cleaning module to transfer fluid residue from the nozzle surface and the nozzles to the used wicking member portion to perform the subsequent cleaning operation.

4. The method of claim 2, wherein the applying a second pressure that is less than a first pressure to increase the second amount of back pressure within the fluid ejection assembly and the nozzles to form a third amount of back pressure therein by the pressurization module in response to a completion of the cleaning operation comprises:

deflating the inflatable bag of the pressurization module to apply the second pressure to increase the second amount of back pressure within the fluid ejection assembly and the nozzles to form the third amount of back pressure therein response to the completion of the cleaning operation.

5. The method of claim 1, wherein the moving at least one of the fluid ejection assembly and a wicking member of a cleaning module against each other to perform the cleaning operation further comprises:

moving the wicking member relative to the fluid ejection assembly against and across the nozzle surface to transfer fluid residue from at least one of the nozzle surface and the nozzles to a portion of the wicking member to form a used wicking member portion.

6. The method of claim 1, wherein the applying a first pressure to lower the first amount of back pressure within the fluid ejection assembly and the nozzles to form a second amount of back pressure therein by a pressurization module in response to an activation of a cleaning operation comprises:

inflating the inflatable bag of the pressurization module to apply the first pressure to lower the first amount of back pressure within the fluid ejection assembly and the nozzles to form the second amount of back pressure therein in response to the activation of the cleaning operation.

7. A printing apparatus, comprising:

a fluid ejection assembly including a nozzle surface having a plurality of nozzles, the fluid ejection assembly to eject printing fluid from the nozzles;

a back pressure regulator to provide a nominal back pressure to the fluid ejection assembly and the nozzles to form a first amount of back pressure therein;

a cleaning module to selectively move a wicking member against the nozzle surface to remove fluid residue from at least one of the nozzle surface and the nozzles thereof during a cleaning operation; and a pressurization module including an inflatable bag and a resilient member to interact with the inflatable bag based on an inflation state of the inflatable bag to apply a first pressure to lower the first amount of back pressure within the fluid ejection assembly and the nozzles to form a second amount of back pressure therein in response to an activation of the cleaning operation.

8. The printing apparatus of claim 7, wherein the pressurization module is configured to apply a second pressure that is less than the first pressure to increase the second amount of back pressure within the fluid ejection assembly and the nozzles to form a third amount of back pressure therein in response to a completion of the cleaning operation.

9. The printing apparatus of claim 8, wherein the pressurization module further comprises:

an air movement unit to selectively provide air to inflate the inflatable bag; and a valve to regulate air flow and to remove the air from and deflate the inflatable bag.

10. The printing apparatus of claim 9, wherein the inflatable bag is configured to inflate to apply the first pressure to lower the first amount of back pressure within the fluid ejection assembly and the nozzles to form a second amount of back pressure therein in response to the activation of the cleaning operation.

11. The printing apparatus of claim 9, wherein the inflatable bag is configured to deflate to apply the second pressure that is less than the first pressure to increase the second amount of back pressure within the fluid ejection assembly and the nozzles to form the third amount of back pressure therein in response to the completion of the cleaning operation.

12. The printing apparatus of claim 7, wherein the wicking member is configured to attract fluid residue from at least one of the nozzle surface and the nozzles to a portion of the wicking member to form a used wicking member portion.

13. The printing apparatus of claim 12, wherein the cleaning module is configured to move the used wicking member portion against and across the nozzle surface to attract fluid residue from at least one of the nozzle surface and the nozzles thereto during a subsequent cleaning operation.

14. The printing apparatus of claim 13, wherein the cleaning module includes at least one cleaner transport member to move the wicking member against and across the nozzle surface.

15. A printing system, comprising:

a fluid ejection assembly including a nozzle surface having a plurality of nozzles, the fluid ejection assembly to eject printing fluid from the nozzles;

a back pressure regulator to provide a nominal back pressure to the fluid ejection assembly and the nozzles to form a first amount of back pressure therein;

a cleaning module including a wicking member and cleaner transport members, the cleaner transport members to move the wicking member against and across the nozzle surface to attract fluid residue from at least one of the nozzle surface and the nozzles to a portion of the wicking member to form a used wicking member portion during a cleaning operation; and a pressurization module including a resilient member and an inflatable bag, the inflatable bag to inflate and interact with the resilient member to apply a first pressure to lower the first amount of back pressure within the fluid ejection assembly and the nozzles to form a second amount of back pressure therein in response to the activation of the cleaning operation.

16. The printing system of claim 15, further comprising:

the inflatable bag to deflate to apply a second pressure that is less than the first pressure to increase the second amount of back pressure within the fluid ejection assembly and the nozzles to form a third amount of back pressure therein in response to a completion of the cleaning operation.

17. The printing system of claim 16, further comprising:

the inflatable bag to inflate to apply the first pressure to lower the third amount of back pressure within the fluid ejection assembly and the nozzles to form a fourth amount of back pressure therein in response to an activation of a subsequent cleaning operation.

18. The printing system of claim 17, further comprising:

the cleaner transport members to move the used wicking member portion against and across the nozzle surface to attract fluid residue from at least one of the nozzle surface and the nozzles to the used wicking member portion during the subsequent cleaning operation.

* * * * *

UNITED STATES PATENT AND TRADEMARK OFFICE

CERTIFICATE OF CORRECTION

PATENT NO. : 8,870,344 B2
APPLICATION NO. : 13/847041
DATED : October 28, 2014
INVENTOR(S) : Scott Martin et al.

It is certified that error appears in the above-identified patent and that said Letters Patent is hereby corrected as shown below:

In the Claims:

In column 7, line 34, in Claim 1, delete “regulator,” and insert -- regulator; --, therefor.

In column 8, line 7, in Claim 4, delete “therein” and insert -- therein in --, therefor.

Signed and Sealed this
Seventeenth Day of March, 2015

Michelle K. Lee

Michelle K. Lee
*Director of the United States Patent and Trademark Office*